US008432091B2

(12) United States Patent
Sakakura

(10) Patent No.: US 8,432,091 B2
(45) Date of Patent: Apr. 30, 2013

(54) CORROSION SUPPRESSING SPARK PLUG

(75) Inventor: Yasushi Sakakura, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 48 days.

(21) Appl. No.: 12/470,175

(22) Filed: May 21, 2009

(65) Prior Publication Data

US 2009/0289539 A1 Nov. 26, 2009

(30) Foreign Application Priority Data

May 21, 2008 (JP) ..... 2008-133603

(51) Int. Cl.
*H01T 13/08* (2006.01)

(52) U.S. Cl.
USPC ..... 313/141; 313/144

(58) Field of Classification Search ..... 313/118–145, 313/18; 123/169 EL, 169 R; 445/7; 219/121; 29/874–876, 33 N, 33 M
See application file for complete search history.

(56) References Cited

U.S. PATENT DOCUMENTS 5,465,022 A 11/1995 Katoh et al.
6,078,129 A * 6/2000 Gotou et al. ..... 313/141
6,346,766 B1 2/2002 Kanao et al.
6,923,699 B2 8/2005 Matsubara et al.
2002/0003389 A1* 1/2002 Ishiguro ..... 313/141
2005/0134160 A1 6/2005 Yamanaka

FOREIGN PATENT DOCUMENTS

| | | | | |
|---|---|---|---|---|
| EP | 1 376 791 | A1 | | 1/2004 |
| JP | 59-40482 | A | | 3/1984 |
| JP | 6-111919 | A | | 4/1994 |
| JP | 6111919 | A | * | 4/1994 |
| JP | 8-298178 | A | | 11/1996 |
| JP | 2000-277231 | A | | 10/2000 |
| JP | 2001-110545 | | * | 4/2001 |
| JP | 2003-257581 | A | | 9/2003 |
| JP | 2005-183167 | A | | 7/2005 |

* cited by examiner

*Primary Examiner* — Anh Mai
*Assistant Examiner* — Fatima Farokhrooz
(74) *Attorney, Agent, or Firm* — Sughrue Mion, PLLC

(57) ABSTRACT

A spark plug including: a center electrode; an insulator; a metal shell; a ground electrode; and an electrode chip. The electrode chip is joined to the ground electrode in a state in which the electrode chip is engaged in a recess portion formed in the ground electrode. The electrode chip is formed by previously welding a chip body portion containing a noble metal and a chip holding portion containing Ni before the electrode chip is joined to the ground electrode. A first molten bond is formed by welding the chip body portion and the chip holding portion. The first molten bond is placed in the recess portion so as not to be exposed to an outside environment in a state in which the electrode chip is engaged in the recess portion and joined to the ground electrode.

9 Claims, 6 Drawing Sheets

CORROSION SUPPRESSING SPARK PLUG

BACKGROUND OF THE INVENTION

1. Field of the Invention

The present invention relates to a spark plug for an internal combustion engine, and more particularly to a spark plug including an electrode chip joined to a ground electrode at a position opposing a center electrode via a spark discharge gap formed therebetween.

2. Description of the Related Art

A spark plug including an electrode chip jointed to a distal end portion of a ground electrode at a position opposing a center electrode so as to enhance ignitability is known. To decrease wear and tear resulting from spark discharge, a noble metal having a high spark wear resistance (for example, Ir) is used for the electrode chip.

Since the ground electrode is generally formed of an Ni based alloy, the ability to join such noble metal to the ground electrode by welding is poor. In order to enhance the joinability, a spark plug including a molten bond is known (see, for example, U.S. Pat. No. 7,030,544). The molten bond is formed by laser welding around the periphery of an electrode chip (noble metal member). The molten bond reduces a difference in thermal expansion between the ground electrode and the electrode chip, to thereby enhance joinability. In U.S. Pat. No. 7,030,544, in order to increase joinability, a recessed portion is formed on the ground electrode. Further, while an electrode chip is fitted into the recessed portion, a laser beam is applied from a direction perpendicular to the boundary between the ground electrode and the electrode chip, to thereby form the molten bond.

However, in U.S. Pat. No. 7,030,544, the laser beam is applied to a side surface of the ground electrode, but cannot be applied from an extending direction (i.e., a direction opposite the tip end surface) of the ground electrode. Namely, a molten bond is not formed on the side of the electrode chip opposite the tip end surface of the ground electrode. Consequently, upon subjecting the spark plug to cooling and heating cycles in use, it is difficult to sufficiently reduce the thermal expansion difference between the electrode chip and the ground electrode. Thus, the electrode chip may dislodge in a part where no molten bond is formed. Further, the molten bond is formed as an alloy layer of a mixture of a component of the electrode chip and a component of the ground electrode. When the alloy layer contains a relatively large amount of the component of the electrode chip, oxidation corrosion easily occurs in the alloy layer as compared with the electrode chip and the ground electrode. Thus, if an outer surface of the molten bond formed of the alloy layer is exposed to combustion gas, oxidation corrosion is likely to occur, which leads to separation (falling off) of the electrode chip.

SUMMARY OF THE INVENTION

The invention was made in consideration of the above circumstances, and an object thereof is to provide a spark plug capable of more reliably joining a ground electrode and an electrode chip, and which suppresses the occurrence of oxidation corrosion in a molten bond formed between the ground electrode and the electrode chip.

In a first aspect, the present invention provides a spark plug comprising: a center electrode; an insulator having an axial hole extending in an axial direction and holding the center electrode in the axial hole; a metal shell which holds the insulator and surrounds a radial periphery of the insulator in a circumferential direction; a ground electrode comprising a first end portion joined to the metal shell and a second end portion, the ground electrode being bent such that the second end portion faces a leading end portion of the center electrode; and an electrode chip joined to the ground electrode in a state in which the electrode chip is engaged in a recess portion formed in the second end portion of the ground electrode at a position opposing the leading end portion of the center electrode, wherein the electrode chip is formed by previously welding a chip body portion formed of a noble metal or an alloy containing a noble metal as a main component and a chip holding portion formed of Ni or an alloy containing Ni as a main component prior to joining the electrode chip to the ground electrode, wherein a first molten bond is formed by welding the chip body portion and the chip holding portion, and wherein the first molten bond is placed in the recess portion so as not to be exposed to an outside environment, in a state in which the electrode chip is engaged in the recess portion and joined to the ground electrode.

In a second aspect, the present invention provides a spark plug according to the first aspect, wherein the ground electrode and the electrode chip are joined by welding the chip holding portion and the ground electrode, wherein a second molten bond is formed by welding the chip holding portion and the ground electrode, and wherein the second molten bond is separated from the first molten bond.

In a third aspect, the present invention provides a spark plug according to the second aspect, comprising a plurality of the second molten bonds, wherein the second molten bonds are formed by spot welding, and when viewed along a direction perpendicular to a surface of the second end portion in which the electrode chip is provided, the second molten bonds are symmetrically formed around the chip body portion in a sequential manner.

In a fourth aspect, the present invention provides a spark plug according to the first aspect, wherein the ground electrode and the electrode chip are joined by welding the chip holding portion and the ground electrode, wherein a second molten bond is formed by welding the chip holding portion and the ground electrode such that the second molten bond is connected to the first molten bond, and wherein the second molten bond comprises an exposed surface layer, the surface layer containing a noble metal in an amount of 20 mass % or less.

In a fifth aspect, the present invention provides a spark plug according to the fourth aspect, wherein when viewed along a direction perpendicular to a surface of the second end portion in which the electrode chip is provided, the second molten bond is formed over the entire periphery of the chip body portion along a boundary between the chip holding portion and the ground electrode.

In a sixth aspect, the present invention provides a spark plug according to any of the first to fifth aspects, wherein the chip body portion of the electrode chip contains Ir as a main component.

In the spark plug of the first aspect, the electrode chip is formed by welding the chip body portion formed of a noble metal or an alloy mainly containing a noble metal, and the chip holding portion is made of Ni or an alloy mainly containing Ni. The first molten bond formed by welding the chip body portion and the chip holding portion is placed in the recess portion of the ground electrode when the electrode chip is joined to the ground electrode. Accordingly, the first molten bond in which the noble metal component of the chip body portion is mixed is not exposed to an outside environment, and therefore is not directly exposed to combustion gas. Consequently, the occurrence of oxidation corrosion in the first molten bond can be suppressed and joinability of the electrode chip and the ground electrode can be enhanced.

In the spark plug of the second aspect, the ground electrode and the electrode chip are joined by welding the ground electrode and the chip holding portion, and the second molten bond formed does not overlap the first molten bond and is formed independently thereof. Thus, the component of the chip body portion, namely, the noble metal component mixed in the first molten bond, is not mixed in the second molten bond. Although the second molten bond is exposed to the outside, since a noble metal component is not mixed therein, the occurrence of oxidation corrosion can be suppressed and thus joinability of the electrode chip and the ground electrode can be enhanced.

In the spark plug of the third aspect, the second molten bonds are formed by spot welding at symmetrical positions around the chip body portion. Thus, even if the internal stress increases due to a thermal expansion difference between the ground electrode and the electrode chip upon receiving heat in operational use, the stress applied to the electrode chip held in the ground electrode is dispersed. Therefore, the difference between a portion on which strong stress is applied and a portion on which weak stress is applied is small and peeling from the weak portion can be suppressed. As a result, joinability of the electrode chip and the ground electrode can be enhanced.

In the spark plug of the fourth aspect, the forming position of the second molten bond (formed by welding the ground electrode and the chip holding portion) overlaps the position of the first molten bond (formed by welding the chip body portion and the chip holding portion), and the second molten bond may be continuously formed with the first molten bond. As a result, the component of the chip body portion, namely, the noble metal component contained in the first molten bond, is mixed in the second molten bond which is exposed to combustion gas. Even in such a case, if the noble metal content of the surface layer where the second molten bond is exposed to combustion gas does not exceed 20 mass %, the occurrence of oxidation corrosion in the second molten bond can be suppressed and joinability of the electrode chip and the ground electrode can be enhanced.

When the noble metal content in the surface layer of the second molten bond does not exceed 20 mass %, occurrence of oxidation corrosion can be yet further suppressed if the second molten bond is formed over the entire periphery of the chip body portion as in the fifth aspect. Further, when the second molten bond is formed over the entire periphery of the chip body portion, the stress applied between the chip holding portion and the ground electrode is dispersed and joinability of the electrode chip and the ground electrode can be enhanced.

In the spark plug of the sixth aspect, the chip body portion of the electrode chip contains Ir as a main component. Ir generally has a high melting point among noble metals and exhibits excellent spark wear resistance. However, Ir has a low thermal conductivity as compared with other noble metals, such as Pt, etc., and when focusing on oxidation resistance, Pt, etc., is desirably used for the chip body portion. However, according to the spark plug of the first to fifth aspects, oxidation corrosion due to use of Ir as the main component of the chip body portion can be sufficiently suppressed. Thus, even if Ir is used as the main component of the chip body portion, high spark wear resistance can be obtained. That is, when Ir is used as the main component of the chip body portion, a greater advantage can be realized in terms of spark wear resistance and oxidation resistance for use as an electrode chip as compared to any other noble metal.

As used herein, the term "main component" means a component having the highest content (in mass %) among all components of a subject member (such as the chip body portion).

DETAILED DESCRIPTION OF THE PREFERRED EMBODIMENTS

Figure 1:
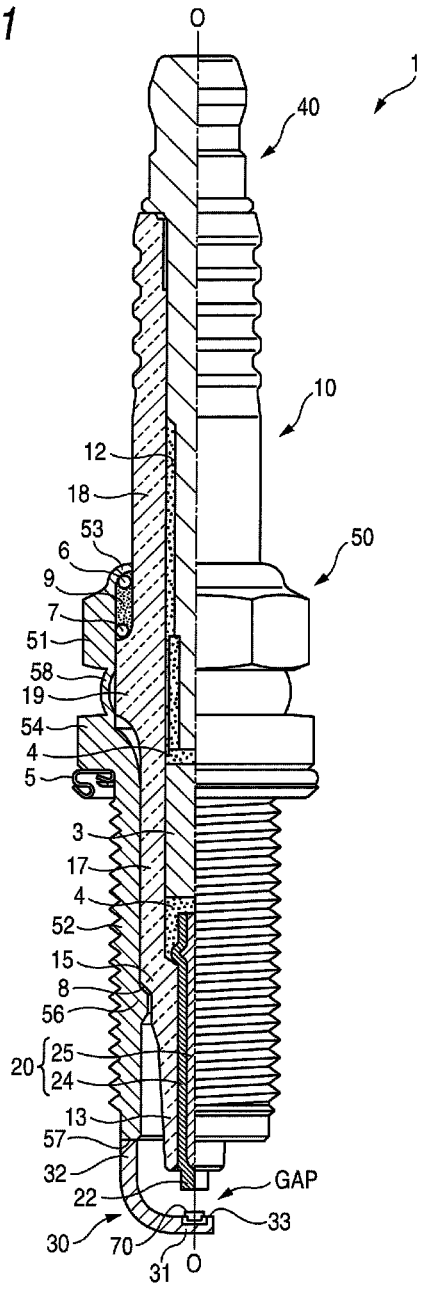
FIG. 1 is a partial sectional view of a spark plug in accordance with an embodiment of the invention.
Figure 2:
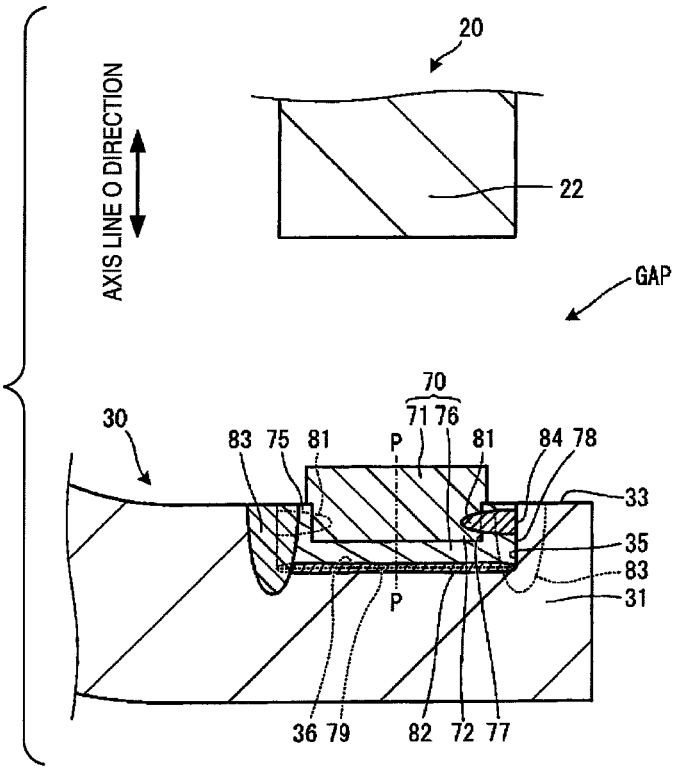
FIG. 2 is an enlarged sectional view showing a distal end portion of a ground electrode.
Figure 3:
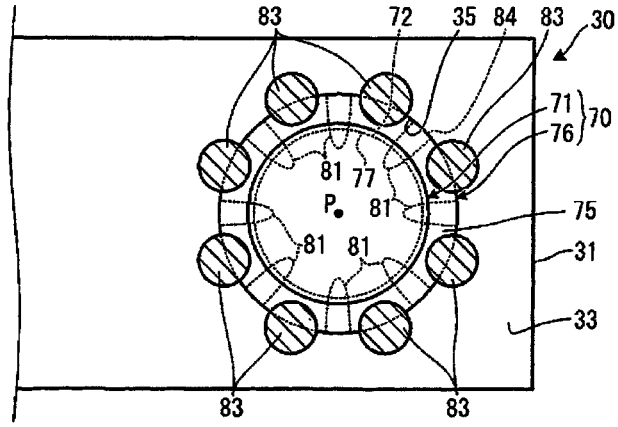
FIG. 3 is a view showing the distal end portion of the ground electrode as viewed along an axial direction from the side of a spark discharge gap.

A spark plug according to an embodiment of the invention will be described with reference to the drawings. However, the present invention should not be construed as being limited thereto. First, the structure of a spark plug 1 will be described with reference to FIGS. 1 to 3. FIG. 1 is a partial sectional view of the spark plug 1. FIG. 2 is an enlarged sectional view showing a distal end portion 31 of a ground electrode 30. FIG. 3 is a view showing the distal end portion 31 of the ground electrode 30 as viewed along a direction of an axis line O from the side of a spark discharge gap GAP. Herein, the direction of axis line O of the spark plug 1 is defied as the up and down direction in FIG. 1, the lower side in FIG. 1 is defined as the leading end side of the spark plug 1, and the upper side is defined as the base end side of the spark plug 1.

As shown in FIG. 1, the spark plug 1 includes: an insulator 10 having an axial hole 12; a center electrode 20 held on the leading end side in the axial hole 12 of the insulator 10; a terminal metal fitting 40 held on the base end side in the axial hole 12 of the insulator 10; and a metal shell 50 holding and surrounding the insulator 10 in a circumferential direction. One end portion of the ground electrode 30 is joined to a leading end surface 57 of the metal shell 50, and an opposite end portion (distal end portion 31) side of the ground electrode 30 is bent toward a leading end portion 22 of the center electrode 20 so as to form a spark discharge gap GAP between the ground electrode 30 and the center electrode 20.

First, the insulator 10 of the spark plug 1 will be described. The insulator 10 is formed by sintering alumina or the like and has a cylindrical shape in which the axial hole 12 is formed to extend in the direction of axis line O in the axial center. The insulator 10 includes a flange portion 19 having a largest outer diameter formed substantially at the center in the direction of axis line O. The insulator 10 further includes a base end side barrel portion 18 closer the base end (the upper side in FIG. 1) than the flange portion 19 and a leading end side barrel portion 17 having an outer diameter smaller than that of the base end side barrel portion 18 formed closer the leading end (the lower side in FIG. 1) than the flange portion 19. The insulator 10 further includes a leg portion 13 having an outer diameter smaller than that of the leading end side barrel portion 17 and formed closer to the leading end than the leading end side barrel portion 17. The leg portion 13 has a reduced diameter toward the leading end thereof. When the spark plug 1 is attached to an engine head (not shown) of an internal combustion engine, the leg portion 13 is exposed to a combustion chamber of the internal combustion engine. A step portion 15 is formed between the leg portion 13 and the leading end side barrel portion 17.

Next, the center electrode 20 will be described. The center electrode 20 is rod-shaped and includes a base member 24 and a core member 25. The base member 24 contains Ni or an alloy containing nickel as a main component thereof such as INCONEL (trade name) 600 or 601. The core member 25 is embedded in the base member 24 and contains copper or an alloy containing copper as a main component which has a thermal conductance higher than that of the electrode base material 24. The center electrode 20 is held on the leading end side in the axial hole 12 of the insulator 10 and has a leading end portion 22 which protrudes from the leading end of the insulator 10 toward the leading end side.

The center electrode 20 is electrically connected to the terminal metal fitting 40 on the base end (the top in FIG. 1) via a conductive seal body 4 and a ceramic resistor 3 which extend in the direction of axis line O in the axial hole 12. When the spark plug 1 is used, a high-tension cable (not shown) is connected to the terminal metal fitting 40 through a plug cap (not shown) so that a high voltage is applied thereto.

Next, the metal shell 50 will be described. The metal shell 50 is a cylindrical metal shell used for fixing the spark plug 1 to an engine head (not shown) of an internal combustion engine. The metal shell 50 holds the insulator 10 therein so as to surround the insulator 10 from a part of the base end side barrel portion 18 to the leg portion 13. The metal shell 50 is formed of a low-carbon steel, and includes a tool engagement portion 51 for engaging a spark plug wrench (not shown) and a mounting portion 52 having a threaded portion to be screwed into a mounting hole (not shown) of the engine head.

A flange-shaped seal portion 54 is formed between the tool engagement portion 51 and the mounting portion 52 of the metal shell 50. An annular gasket 5 formed by bending a plate body is inserted between the mounting portion 52 and the seal portion 54. When the spark plug 1 is attached to the mounting hole (not shown) of the engine head, the gasket 5 is pressed and deformed between the seal portion 54 and an opening peripheral edge portion of the mounting hole and seals a space between the seal portion 54 and the opening peripheral edge portion. Accordingly, the gasket 5 can prevent gas leakage from inside the engine through the mounting hole.

The metal shell 50 includes a thin crimping portion 53 at a position closer to the base end than the tool engagement portion 51. The metal shell 50 further includes a thin buckling portion 58 similar to the crimping portion 53 between the seal portion 54 and the tool engagement portion 51. Annular ring members 6 and 7 are interposed between the inner circumferential surface of the metal shell 50 and the outer circumferential surface of the base end side barrel portion 18 of the insulator 10 at a region from the tool engagement portion 51 to the crimping portion 53. A space between the ring members 6 and 7 is filled with talc powder 9. The insulator 10 is pressed toward the leading end side in the metal shell 50 through the ring members 6 and 7 and the talc powder 9 by bending and crimping the crimping portion 53 inwardly. Accordingly, the step portion 15 of the insulator 10 is supported by a step portion 56 formed at the position of the mounting portion 52 at the inner periphery of the metal shell 50 via an annular plate packing 8, and the metal shell 50 and the insulator 10 are combined together. Airtightness between the metal shell 50 and the insulator 10 is maintained by the plate packing 8, to thereby prevent combustion gas from leaking out through the spark plug. The buckling portion 58 is bent and deformed outwardly by applying a compression force when crimped, and the compression stroke of the talc powder 9 in the direction of axis line O is made large, so that the airtightness in the metal shell 50 is improved.

Next, the ground electrode 30 will be described. The ground electrode 30 is a rod-shaped electrode having rectangular shape in cross section and is formed of Ni or an alloy containing Ni as a main component, such as INCONEL (trade name) 600 or 601, similar to the center electrode 20. One end portion (base end portion 32) of the ground electrode 30 is joined to the leading end surface 57 of the metal shell 50 and extends along the direction of axis line O, and an opposite end portion (distal end portion 31) of the ground electrode 30 is bent toward the leading end portion 22 of the center electrode 20. In the distal end portion 31, an inner surface 33 of the ground electrode 30 faces the leading end portion 22 of the center electrode 20, and a spark discharge gap GAP is formed between the distal end portion 31 of the ground electrode 30 and the leading end portion 22 of the center electrode 20.

As shown in FIG. 2, a recess portion 35 is formed at a position of the inner surface 33 in the distal end portion 31 of the ground electrode 30 which opposes the leading end portion 22 of the center electrode 20. An electrode chip 70 engages the recess portion 35 such that the electrode chip 70 protrudes from the inner surface 33 toward the leading end portion 22 of the center electrode 20, and in this state, the electrode chip 70 is joined to the ground electrode 30. The electrode chip 70 includes: a chip body portion 71 formed of noble metal having high spark wear resistance, for example, Pt, Ir or Rh, or an alloy containing a noble metal as a main component; and a chip holding portion 76 formed of Ni or an alloy containing Ni as a main component. The chip body portion 71 and the chip holding portion 76 are joined to form a single, integrated piece.

As shown in FIGS. 2 and 3, the chip body portion 71 has a columnar shape with axis P extending in the direction of axis line O of the spark plug 1. The chip body portion 71 includes a reduced diameter portion 72 at one end side of the chip body portion 71 (the lower side in FIG. 2) in the direction of columnar axis P and has an outer diameter smaller than that of another end side of the chip body portion 71. The chip holding portion 76 is disk-shaped and has an engagement portion 77 formed on one surface of the chip holding portion 76. The engagement portion 77 is a recess portion having an angular U-shape in cross section defined by a peripheral edge portion 75 as an upright side wall. The chip body portion 71 and the chip holding portion 76 are joined via a molten bond 81 formed by laser welding in a state in which the reduced diameter portion 72 of the chip body portion 71 is engaged with the engagement portion 77 of the chip holding portion 76, so that the chip body portion 71 and the chip holding portion 76 are formed into a single piece. As shown in FIG. 3, the molten bonds 81 are formed at eight separated portions in the circumferential direction of an outer circumferential surface 78 of the chip holding portion 76. Each of the molten bonds 81 inwardly penetrates the peripheral edge portion 75 in the radial direction from the circumferential surface 78 of the chip holding portion 76 and extends into the chip body portion 71 (see FIG. 3). The chip body portion 71 and the chip holding portion 76 thus joined in one piece constitute the electrode chip 70. The molten bond 81 is one example of a first molten bond.

The electrode chip 70 is engaged with the recess portion 35 such that the chip holding portion 76 is inserted into the recess portion 35 provided on the inner surface 33 of the ground electrode 30, and the chip body portion 71 protrudes from the inner surface 33, as shown in FIG. 2. In this state, the peripheral edge portion 75 of the chip holding portion 76 is accommodated in the recess portion 35 so that the outer circumferential surface 78 having an exposure surface 84 (namely, a laser beam incident surface for forming molten bonds 81) of the molten bond 81 is also accommodated in the recess portion 35. A bottom surface 79 of the chip holding portion 76 (surface opposite the engagement portion 77) is resistance-welded to a bottom surface 36 of the recess portion 35 of the ground electrode 30.

Further, as shown in FIGS. 2 and 3, the peripheral edge portion 75 of the chip holding portion 76 and an edge portion of the recess portion 35 on the inner surface 33 of the ground electrode 30 are joined by laser welding to form a molten bond 83 which constitutes a joint portion. As shown in FIG. 3, the molten bonds 83 are formed at eight separate portions along the boundary between the chip holding portion 76 and the ground electrode 30 in the circumferential direction and in such manner as to avoid the forming positions of the molten bond 81. In other words, the molten bond 81 and the molten bond 83 do not overlap and are formed at independent positions. The molten bonds 83 are formed so as not to contact the chip body portion 71 and are formed at symmetrical positions around the chip body portion 71. Thus, the electrode chip 70, which includes the chip body portion 71 and the chip holding portion 76 formed in a single piece by means of the molten bond 81, is fixed to the ground electrode 30 by means of the molten bond 83. The electrode chip 70 acts as a starting point, on the ground electrode 30 side, of the spark discharge performed between the leading end portion 22 of the center electrode 20 and the distal end portion 31 of the ground electrode 30. The molten bond 83 is an example of a second molten bond.

In the spark plug 1 of this embodiment, when the molten bond 81 joining the chip body portion 71 and the chip holding portion 76 is formed, the component containing a noble metal derived from the chip body portion 71 and the component containing Ni of the chip holding portion 76 are mixed. The exposure surface 84 of the molten bond 81 extends to the outer circumferential surface 78 of the chip holding portion 76, and the outer circumferential surface 78 is accommodated in the recess portion 35 of the ground electrode 30 as described above. Thus, the molten bond 81 with the noble metal component mixed therein is not directly exposed to combustion gas. Consequently, oxidation corrosion which generally proceeds more readily as the content percentage of the noble metal increases can be effectively suppressed.

The molten bond 83 joining the chip holding portion 76 of the electrode chip 70 and the ground electrode 30 is formed at a portion which avoids the forming positions of the molten bond 81. That is, in this embodiment the molten bond 83 is formed independently of the molten bond 81. Thus, the component of the chip body portion 71 contained in the molten bond 81 is not mixed into the molten bond 83 at the time that the molten bond 83 is formed. The molten bond 83 is formed to fix the electrode chip 70 to the ground electrode 30. Thus, a portion of the molten bond 83 is exposed to the outside air. However, since the molten bond 81 and the molten bond 83 are formed independently, the component containing the noble metal derived from the chip body portion 71 is not mixed with the molten bond 83 such that oxidation corrosion of the molten bond 83 can be suppressed.

Since the molten bonds 83 are formed at symmetrical positions surrounding the chip body portion 71, the joint strength of the electrode chip 70 and the ground electrode 30 is dispersed (i.e., not deflected to one side in the circumferential direction), and the joint state of the electrode chip 70 and the ground electrode 30 can be maintained in use over a long term. Further, in this embodiment, in joining the electrode chip 70 to the ground electrode 30, the bottom surface 79 of the chip holding portion 76 is resistance-welded to the bottom surface 36 of the recess portion 35 of the ground electrode 30. Accordingly, joint bonding the electrode chip 70 and the ground electrode 30 can be made stronger.

As described above, a noble metal having high spark wear resistance, for example, Pt, Ir or Rh, or an alloy containing a noble metal as a main component is used for the chip body portion 71 of the electrode chip 70. Since the chip body portion 71 is the starting point of spark discharge with the opposing leading end portion 22 of the center electrode 20 in the spark discharge gap GAP, the material of the chip body portion 71 is desirably selected so as to impart excellent spark wear resistance. Particularly, Ir has a high melting point among noble metals and if used for the chip body portion 71, Ir can provide superior spark wear resistance. On the other hand, because Ir has a low thermal conductivity relative to other noble metals; oxidation corrosion may occur due to contact with the combustion gas, and particularly in the molten bond 81 within the chip holding portion 76. However, when the molten bond 81 is shielded from exposure to combustion gas as in this embodiment, or when the component containing the noble metal derived from the chip body portion 71 is small (even if the molten bond 81 is exposed to combustion gas through the molten bond 83), it is possible to sufficiently suppress oxidation corrosion. Thus, when Ir is used as the main component of the chip body portion 71, superior spark wear resistance and oxidation resistance of the electrode chip 70 is realized as compared to any other noble metal.

The electrode chip 70 can be joined to the ground electrode 30 through the following process. First, the chip body portion 71 is formed from a noble metal or a noble metal alloy such that the chip body portion 71 includes the reduced diameter portion 72 and has a circular cylinder shape with a step. A disk-shaped plate body is formed from Ni or an Ni alloy, and an edge portion is raised upright on the plate surface to form the chip holding portion 76. The reduced diameter portion 72 of the chip body portion 71 is engaged with the engagement portion 77 of the chip holding portion 76, a laser beam is applied from the outer circumferential surface 78 of the chip holding portion 76 in an inwardly radial direction relative to the cylindrical axis P of the chip body portion 71 to perform spot welding, and the molten bond 81 penetrating the peripheral edge portion 75 and reaching the chip body portion 71 is formed. Accordingly, the electrode chip 70 is produced. The electrode chip 70 is inserted and fitted into the recess portion 35 provided in the inner surface 33 of the ground electrode 30 from the chip holding portion 76 side. Next, the bottom surface 79 of the chip holding portion 76 is resistance-welded to the bottom surface 36 of the recess portion 35 of the ground electrode 30 to join the electrode chip 70 to the ground electrode 30. Further, a laser beam is applied to the boundary between the chip holding portion 76 and the ground electrode 30 along the cylindrical axis P direction of the chip body portion 71 to perform spot welding. At this time, the molten bond 83 is formed at a position so as to avoid the forming positions of the molten bond 81, and the electrode chip 70 is joined to the ground electrode 30.

Figure 4:
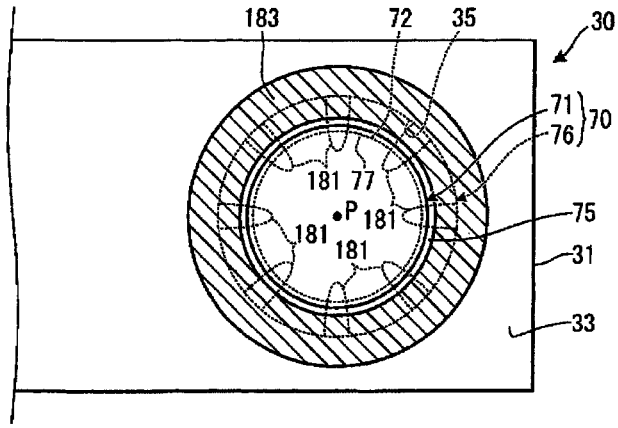
FIG. 4 is a drawing showing a first modification for forming a molten bond.

The invention can embody various modifications. For example, in the above embodiment, the chip holding portion 76 and the ground electrode 30 are joined through the molten bonds 83 formed discontinuously so as to avoid the forming positions of the molten bond 81 and at symmetrical positions surrounding the chip body portion 71. However, the molten bond 83 may also be formed continuously along the boundary between the chip holding portion 76 and the ground electrode 30 as shown in FIG. 4. In this case, a molten bond 181 joining the chip body portion 71 and the chip holding portion 76 of the electrode chip 70 overlaps a molten bond 183 joining the chip holding portion 76 and the ground electrode 30, and the components of both molten bonds are mixed. Consequently, the component containing the noble metal derived from the chip body portion 71 is mixed with the molten bond 183 and is exposed to the combustion gas. To suppress oxidation corrosion of the molten bond 183, a percentage of the noble metal in all components in a surface layer of the molten bond 183 is preferably 20 mass % or less. The surface layer, specifically, is a portion of the molten bond 183 of the exposure surface exposed to combustion gas to a depth of 10 μm in the cylindrical axis P direction of the chip body portion 71. Although the chip holding portion 76 and the ground electrode 30 are formed of Ni or an Ni alloy, Ni and the noble metal derived from the chip body portion 71 are mixed in the molten bond 183. It is known that as the percentage of noble metal contained in a noble metal alloy increases, oxidation corrosion more readily occurs. According to Example 2 described below, if the noble metal contained in all components in the surface layer of the molten bond 183 is set to 20 mass % or less, the occurrence of oxidation corrosion can be sufficiently suppressed.

In the embodiment, the molten bonds 81 of the joining portion of the chip body portion 71 and the chip holding portion 76 are formed discontinuously in the circumferential direction on the outer circumferential surface 78 of the chip holding portion 76. However, the molten bonds 81 may also be formed continuously around the outer periphery. In the above embodiment, the molten bond 81 and the molten bond 83 are respectively formed so as not to overlap at eight positions symmetrically surrounding the chip body portion 71, but the number of forming portions is not limited to eight and may be at least three or more. Although laser welding is exemplified as the welding method, other welding methods such as TIG (Tungsten Inert Gas) welding or electron beam welding may be used.

The inner surface 33 having the electrode chip 70 joined thereto is one surface of the ground electrode 30. It is a surface directed to the leading end portion 22 of the center electrode 20, and does not necessarily point to a bent inward surface of the ground electrode 30. For example, the invention can also be applied to a spark plug of the type in which the electrode chip 70 is joined to an end surface of the distal end portion 31 of the ground electrode 30 (that is, the most distal end surface in the lengthwise direction).

Figure 5:
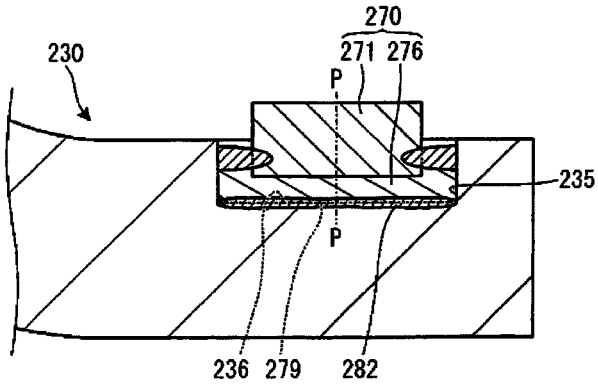
FIG. 5 is a drawing showing a second modification for joining an electrode chip to a ground electrode.

As shown in FIG. 5 illustrating an electrode chip 270, a chip holding portion 276 and a recess portion 235 of a ground electrode 230 may be joined by resistance-welding a bottom surface 279 and a bottom surface 236 to form a molten bond 282. In that case, the molten bond 83 (see FIG. 2) formed by laser welding may not be needed. A reduced diameter portion 72 (see FIG. 2) of a chip body portion 271 also may not be needed.

Figure 6:
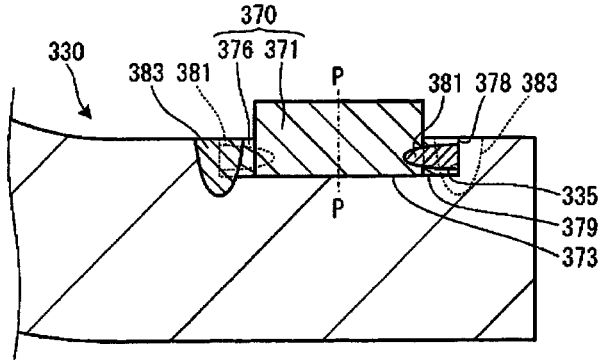
FIG. 6 is a drawing showing a third modification for joining an electrode chip to a ground electrode.

A chip holding portion 376 may have an annular shape as shown in FIG. 6 illustrating an electrode chip 370. In this case, laser welding is performed inward in the radial direction from an outer circumferential surface 378 of a chip holding portion 376 in a state in which a bottom surface 373 of a chip body portion 371 and a bottom surface 379 of the chip holding portion 376 are arranged horizontally. In this manner, a molten bond 381 penetrating the chip holding portion 376 and reaching the chip body portion 371 is formed. Accordingly, the electrode chip 370 is produced. The electrode chip 370 may be inserted and fitted into a recess portion 335 of a ground electrode 330 from the bottom surface 373 side. A laser beam may be applied to the boundary between the chip holding portion 376 and the ground electrode 330 along the cylindrical axis P direction of the chip body portion 371 so as to form a molten bond 383 as in the embodiment, and the electrode chip 370 may be joined to the ground electrode 330.

Figure 7:
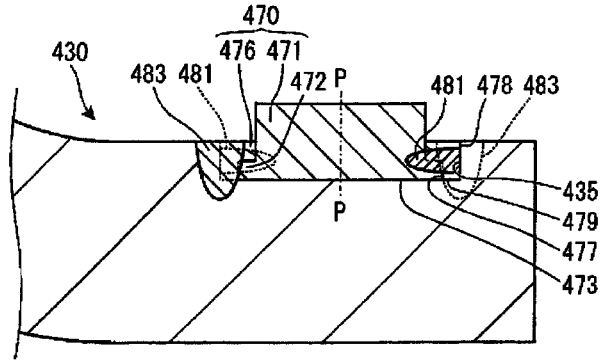
FIG. 7 is a drawing showing a fourth modification for joining an electrode chip to a ground electrode.

As shown in FIG. 7 illustrating an electrode chip 470, a flange-shaped enlarged diameter portion 472 may be provided in a chip body portion 471 on a bottom surface 473 side, a chip holding portion 476 (having a bottom surface 479) may be annular-shaped, the inner periphery on the bottom surface 473 side may be enlarged, and an engagement portion 477 may be provided to engage the enlarged diameter portion 472 of the chip body portion 471. In this case, the chip holding portion 476 is attached so as to cover the chip body portion 471 with the chip holding portion 476, and the enlarged diameter portion 472 is engaged in the engagement portion 477. Thereafter, in a similar manner to that described above, laser welding is performed inward in the radial direction from an outer circumferential surface 478 of the chip holding portion 476, to thereby form a molten bond 481 penetrating the chip holding portion 476 and reaching the chip body portion 471. Accordingly, the electrode chip 470 is produced. The electrode chip 470 may be inserted and fitted into a recess portion 435 of a ground electrode 430 from the bottom surface 473 side, a laser beam may be applied to the boundary between the chip holding portion 476 and the ground electrode 430 so as to form a molten bond 483 without overlapping the molten bond 481 along the cylindrical axis P direction of the chip body portion 471, and the electrode chip 470 may be joined to the ground electrode 430. The chip holding portion 476 can function as a stopper for preventing the enlarged diameter portion 472 of the chip body portion 471 from falling off, and can also prevent separation of the electrode chip 470 from the ground electrode 430. Further, oxidation corrosion of the molten bond 481 can be sufficiently suppressed because the molten bond 481 is accommodated in the recess portion 435 of the ground electrode 430 and is not exposed to combustion gas as in the above embodiment.

Figure 8:
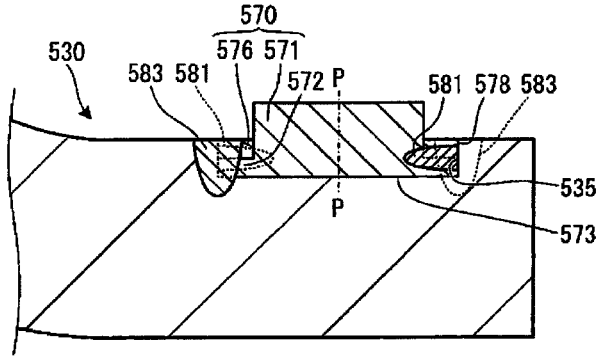
FIG. 8 is a drawing showing a fifth modification for joining an electrode chip to a ground electrode.

A chip holding portion 576 may have a ring shape as shown in FIG. 8 illustrating an electrode chip 570. In this case, a flange-shaped enlarged diameter portion 572 is provided in a chip body portion 571 on a bottom surface 573 side, and the outer diameter of the enlarged diameter portion 572 is set to be the same as the outer diameter of the chip holding portion 576. The chip holding portion 576 is attached so as to cover the chip body portion 571 with the chip holding portion 576, and is placed on the upper side of the enlarged diameter portion 572 (the side opposite the bottom surface 573). In this state, laser welding is performed inward in the radial direction from an outer circumferential surface 578 of the chip holding portion 576. Consequently, a molten bond 581 is formed, and the chip holding portion 576 and the enlarged diameter portion 572 are joined. Accordingly, the electrode chip 570 is produced. Thereafter, the electrode chip 570 is inserted and fitted into a recess portion 535 of a ground electrode 530 from the bottom surface 573 side, a laser beam is applied to the boundary between the chip holding portion 576 (and the enlarged diameter portion 572) of the chip body portion 571 and the ground electrode 530 along the cylindrical axis P direction of the chip body portion 571 so as to form a molten bond 583, and the electrode chip 570 is joined to the ground electrode 530. Even in the electrode chip 570, the chip holding portion 576 functions as a stopper for preventing the enlarged diameter portion 572 of the chip body portion 571 from falling off, and can also prevent separation of the electrode chip 570 from the ground electrode 530, similar to the electrode chip 470 shown in FIG. 7.

Figure 9:
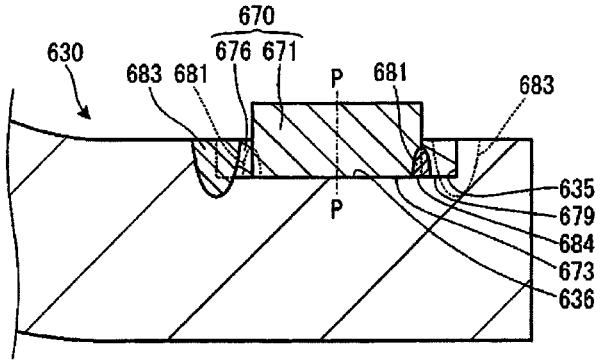
FIG. 9 is a drawing showing a sixth modification for joining an electrode chip to a ground electrode.
Figure 10:
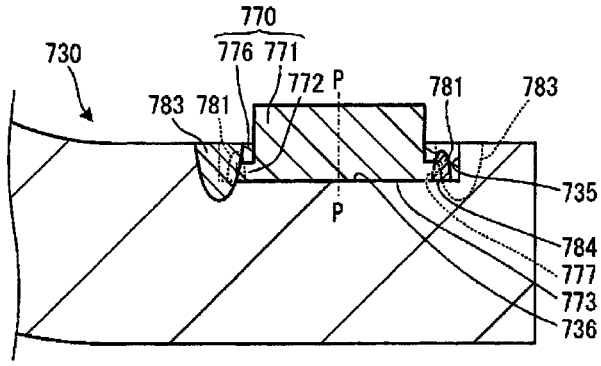
FIG. 10 is a drawing showing a seventh modification for joining an electrode chip to a ground electrode.

An electrode chip 670, 770 shown in FIGS. 9, 10 differs from the electrode chip 370, 470 shown in FIG. 6, 7 in the forming position of the molten bond 381, 481 formed when the chip body portion 371, 471 and the chip holding portion 376, 476 are joined to produce the electrode chip 370, 470. Specifically, the electrode chip 670 shown in FIG. 9 is produced by horizontally aligning a bottom surface 673 of a columnar chip body portion 671 and a bottom surface 679 of an annular chip holding portion 676. A laser beam is applied to the boundary between the chip holding portion 676 and the chip body portion 671 along the cylindrical axis P direction from the bottom surface 673 of the chip body portion 671 to thereby form a molten bond 681. The electrode chip 770 shown in FIG. 10 is produced by attaching a chip holding portion 776 so as to cover a chip body portion 771 with the chip holding portion 776, engaging an enlarged diameter portion 772 in an engagement portion 777, and applying a laser beam to the boundary between the chip holding portion 776 and the chip body portion along the cylindrical axis P direction from a bottom surface 773 of the chip body portion 771, to thereby form a molten bond 781. As shown in FIG. 9, 10, the electrode chip 670, 770 and a ground electrode 630, 730 are joined by applying a laser beam to the boundary between the chip holding portion 676, 776 and the ground electrode 630, 730 along the cylindrical axis P direction of the chip body portion 671, 771 to form a molten bond 683, 783 in a similar manner to that described above. According to the electrode chip 670, 770, an exposure surface 684, 784 of the molten bond 681, 781 formed by joining the chip body portion 671, 771 and the chip holding portion 676, 776 is placed on a bottom surface 636, 736 of a recess portion 635, 735 of the ground electrode 630, 730. In this manner, the exposure surface is shielded from combustion gas and oxidation corrosion can be suppressed more effectively.

Figure 11:
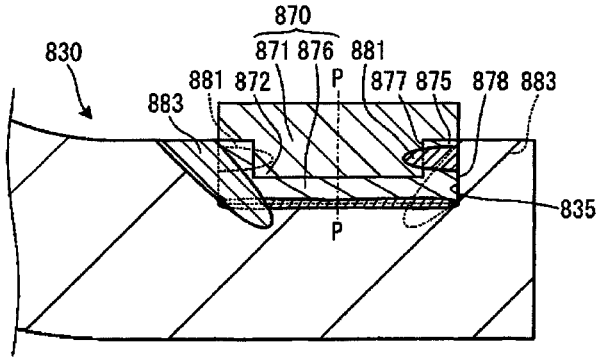
FIG. 11 is a drawing showing a eighth modification for joining an electrode chip to a ground electrode.

An electrode chip 870 shown in FIG. 11 includes a chip body portion 871 and a chip holding portion 876. Similar to the above-described embodiment, the chip body portion 871 including a reduced diameter portion 872 is engaged in the chip holding portion 876 including an engagement portion 877. In this state, a molten bond 881 is formed to penetrate a peripheral edge portion 875 inward in the radial direction from an outer circumferential surface 878 and reach the chip body portion 871. The chip body portion 871 and the chip holding portion 876 is joined by the molten bond 881. Thereafter, the electrode chip 870 is accommodated in a recess portion 835 of a ground electrode 830 from the chip holding portion 876, a laser beam is applied slantingly inward relative to the cylindrical axis P along the outer periphery of the chip body portion 871, and a molten bond 883 for joining the chip holding portion 876 and the ground electrode 830 is formed. The chip body portion 871 of the electrode chip 870 can have a larger outer diameter than that of the above embodiment, thereby enhancing wear resistance of the electrode chip 870.

As described in the above embodiment, the chip body portion 71 made of a noble metal or a noble metal alloy is previously joined to the chip holding portion 76. Further, the molten bond 81 formed at joining the chip body portion 71 and the chip holding portion 76 is accommodated in the recess portion 35 provided in the ground electrode 30 so as not to be exposed to combustion gas. Here, an evaluation test was conducted to confirm the advantages provided by joining the chip holding portion 76 to the ground electrode 30 and arranging the molten bonds 83 at symmetrical positions surrounding the chip body portion 71.

Example 1

First, a joint strength of the electrode chip 70 to the ground electrode 30 was evaluated. An electrode chip (chip body portion: Ir-10Rh (at %), chip holding portion: INCONEL 600) as in the embodiment was prepared, and two samples of a spark plug of the Example with the electrode chip joined to a ground electrode were produced. For comparison, two samples of the spark plug of a Comparative Example were prepared. Each of the Comparative Samples was produced by burying an electrode chip (Ir-10Rh) having a circular cylinder shape in a recess portion provided in a ground electrode. Further, the electrode chip and the ground electrode were joined in the same manner as in U.S. Pat. No. 7,030,544, discussed above.

Figure 12:
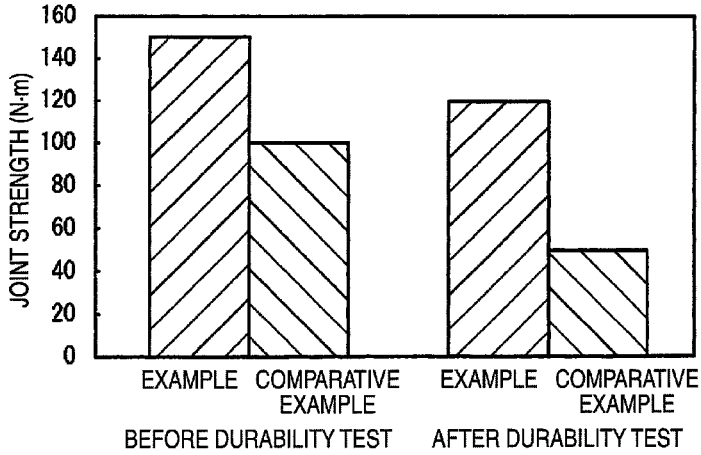
FIG. 12 is a graph showing the comparison result between a spark plug of an Example and a spark plug of a Comparative Example relating to the joint strength of a ground electrode and an electrode chip.

One sample each was taken from the Example and Comparative Example. Then, a hole was made in a portion of a back surface of the ground electrode opposing the inner surface of the ground electrode, the portion corresponding to a recess portion formed in the inner surface such that the electrode chip was exposed from the back surface. Further, each sample (having a exposed electrode chip) was placed on a fixing bed with the inner surface of the sample down, a press pin was inserted into the hole from above, and each electrode chip was pressed downward. The pressing force was gradually increased. The pressing force at the point at which the electrode chip became dislodged was adopted as the joint strength of the electrode chip, and the joint strength was measured for each sample. Each of the remaining spark plug samples was attached to a six-cylinder co-generation engine, and a 1000-hour running (durability test) was conducted at rated output. Then, a hole was made in each of the ground electrodes, and the joint strength of the electrode chip of each sample was measured using a press pin. FIG. 12 shows the results of the evaluation test.

As shown in FIG. 12, the joint strength of the Example was considerably higher than the joint strength of the sample of Comparative Example, and a strength exceeding 150 N·m was obtained in a state before execution of the 1000-hour durability test. After the durability test, the joint strength of the Example was still about 120 N·m, and a strength higher than the joint strength of the Comparative Example was maintained.

Example 2

Figure 13:
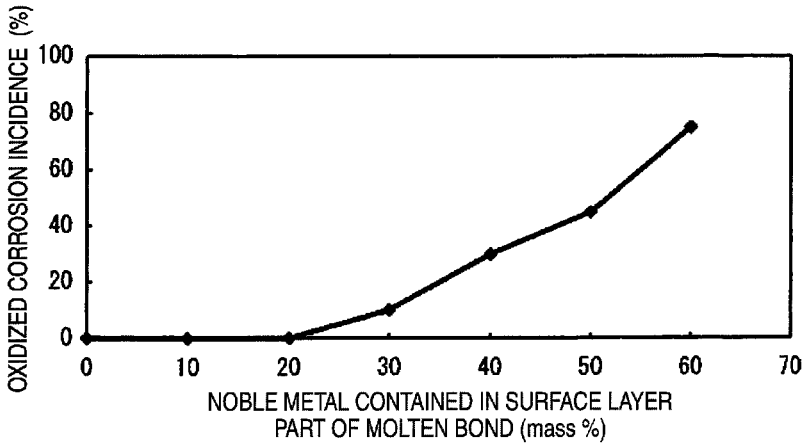
FIG. 13 is a graph showing the relationship between the noble metal content in the surface layer of a molten bond and the occurrence rate of oxidation corrosion.

Next, oxidation corrosion of the molten bond formed by joining the electrode chip 70 and the ground electrode 30 was evaluated. Similar to Example 1, a plurality of electrode chips (chip body portion: Ir-10Rh, chip holding portion: INCONEL 600) as in the above embodiment was prepared and were joined to a plurality of prepared ground electrodes. A plurality of spark plug samples were prepared, having differing mixtures of both molten bonds (a molten bond joining the electrode chip and the ground electrode, and a molten bond joining the chip body portion and the chip holding portion), by shifting the forming position of the molten bond joining the electrode chip and the ground electrode so as to adjust a degree of overlap with the molten bond joining the chip body portion and the chip holding portion. The elements present in the surface layer of the molten bond exposed to the inner surface of the ground electrode of each sample were measured by EPMA (electronic scanning line microanalysis), the noble metal element context as a percentage of all elements was determined, and seven types of samples (10 samples each) having a value ranging from 0 mass % to 60 mass % in steps of 10 mass % were extracted. Next, each of the extracted samples was attached to a six-cylinder co-generation engine and a 1000-hour running (durability test) was conducted at rated output. Then, the occurrence rate of oxidation corrosion in the molten bond in each sample was examined. As used herein, an "oxidation corrosion occurrence state" is a state in which a volume decrease of 1% or more of the molten bond occurs as measured by an X-ray CT (X-ray computed tomography) before and after the durability test. The occurrence rate of oxidation corrosion was determined based on 10 samples each having the same noble metal element percentage. FIG. 13 is a graph showing the results of the evaluation test.

As shown in FIG. 13, when the content of noble metal in the surface layer of the molten bond is 20 mass % or less, oxidation corrosion does not occur. However, when the content exceeds 20 mass %, the occurrence rate of oxidation corrosion in the molten bond increases.

According to the result of the evaluation test, a configuration in which the forming position of the molten bond joining the electrode chip and the ground electrode does not overlap the forming position of the molten bond joining the chip body portion and the chip holding portion was found to be advantageous, such that the content of noble metal in the surface layer of the molten bond is set to 0 mass % (namely, a configuration in which a noble metal is not present). Further, even if the forming positions of both the molten bonds overlap, the occurrence of oxidation corrosion can be sufficiently prevented if the noble metal content is 20 mass % or less in the surface layer of the molten bond between the electrode chip and the ground electrode, which surface layer is exposed to the combustion gas.

It should further be apparent to those skilled in the art that various changes in form and detail of the invention as shown and described above may be made. It is intended that such changes be included within the spirit and scope of the claims appended hereto.

This application is based on Japanese Patent Application No. 2008-133603 filed May 21, 2008, the above application incorporated herein by reference in its entirety.

What is claimed is:

1. A spark plug comprising:

a center electrode;

an insulator having an axial hole extending in an axial direction and holding the center electrode in the axial hole;

a metal shell which holds the insulator and surrounds a radial periphery of the insulator in a circumferential direction;

a ground electrode comprising a first end portion joined to the metal shell and a second end portion, the ground electrode being bent such that the second end portion faces a leading end portion of the center electrode; and an electrode chip joined to the ground electrode such that the electrode chip is engaged in a recess portion formed in the second end portion of the ground electrode at a position opposing the leading end portion of the center electrode, wherein the electrode chip is formed by previously welding a chip body portion formed of noble metal or an alloy containing a noble metal as a main component and a chip holding portion formed of Ni or an alloy containing Ni as a main component prior to joining the electrode chip to the ground electrode, wherein the chip holding portion has a recess portion or has an annular shape such that when the chip body portion is welded to the chip holding portion, the chip holding portion surrounds an outer periphery of the chip body portion, wherein a first molten bond is formed by welding the chip body portion and the chip holding portion, and in the axial direction, the first molten bond is positioned so that a surface of the ground electrode which faces the leading end portion of the center electrode is closer to the leading end portion of the center electrode than the first molten bond, and wherein the first molten bond is placed in the recess portion of the second end portion of the ground electrode so as not to be exposed to an outside environment.

2. The spark plug according to claim 1, wherein the ground electrode and the electrode chip are joined by welding the chip holding portion and the ground electrode, wherein a second molten bond is formed by welding the chip holding portion and the ground electrode, and wherein the second molten bond is separate from the first molten bond.

3. The spark plug according to claim 1, wherein the ground electrode and the electrode chip are joined by welding the chip holding portion and the ground electrode, wherein a second molten bond is formed by welding the chip holding portion and the ground electrode such that the second molten bond is connected to the first molten bond, and wherein the second molten bond comprises an exposed surface layer, the surface layer containing a noble metal in an amount of 20 mass % or less.

4. The spark plug according to claim 1, wherein the chip body portion of the electrode chip contains Ir as a main component.

5. The spark plug according to claim 2, comprising a plurality of the second molten bonds, wherein the second molten bonds are formed by spot welding, and when viewed along a direction perpendicular to a surface of the second end portion in which the electrode chip is provided, the second molten bonds are symmetrically formed around the chip body portion in a sequential manner.

6. The spark plug according to claim 3, wherein when viewed along a direction perpendicular to a surface of the second end portion in which the electrode chip is provided, the second molten bond is formed over the entire periphery of the chip body portion along a boundary between the chip holding portion and the ground electrode.

7. The spark plug according to claim 1, wherein the electrode chip is engaged in a bottom surface of the recess portion formed in the second end portion of the ground electrode.

8. A spark plug comprising:

a center electrode;

an insulator having an axial hole extending in an axial direction and holding the center electrode in the axial hole;

a metal shell which holds the insulator by surrounding a radial periphery of the insulator in a circumferential direction;

a ground electrode comprising a first end portion joined to the metal shell and a second end portion having a recess portion formed at a position facing a leading end portion of the center electrode; and an electrode chip welded to the second end portion of the ground electrode and comprising a chip body portion containing noble metal as a main component and a chip holding portion containing Ni as a main component, the chip body portion being joined to the chip holding portion via a first molten bond in which the chip body portion and the chip holding portion are fused, wherein the chip holding portion has a recess portion or has an annular shape such that when the chip body portion is welded to the chip holding portion, the chip holding portion surrounds an outer periphery of the chip body portion, and in the axial direction, the first molten bond is positioned so that a surface of the ground electrode which faces the leading end portion of the center electrode is closer to the leading end portion of the center electrode than the first molten bond, and wherein the electrode chip is fitted to the recess portion of the second end portion of the ground electrode such that the first molten bond of the electrode chip is not exposed to an outside environment.

9. The spark plug according to claim 8, wherein the electrode chip is fitted to a bottom surface of the recess portion formed in the second end portion of the ground electrode.

* * * * *